United States Patent [19]

Baughman

[11] 3,967,801

[45] July 6, 1976

[54] SIGNAL SYSTEM FOR HIGH SPEED TRAINS

[76] Inventor: George W. Baughman, The Cloisters, Apt. 517, 106 Interlachen Ave., Winter Park, Fla. 32789

[22] Filed: Sept. 26, 1974

[21] Appl. No.: 509,476

[52] U.S. Cl. ..... 246/34 R; 246/182 R; 246/187 B

[51] Int. Cl.[2] ..... B61L 21/10

[58] Field of Search ..... 246/3, 4, 34 R, 187 B, 246/187 C, 186, 187 R, 182 R; 104/149, 153

[56] References Cited

UNITED STATES PATENTS

| | | | |
|---|---|---|---|
| 3,395,274 | 7/1968 | Baughman | 246/34 R |
| 3,395,275 | 7/1968 | Baughman | 246/187 R |
| 3,401,259 | 9/1968 | Baughman | 246/34 R |
| 3,501,629 | 3/1970 | Aiken | 246/34 R |
| 3,593,022 | 7/1971 | Hoyler | 246/34 R |

*Primary Examiner*—M. Henson Wood, Jr.
*Assistant Examiner*—Reinhard J. Eisenzopf

[57] ABSTRACT

This invention relates to a signal system for high speed vehicles traveling along a predetermined way. In the system vehicles are controlled from the wayside through the use of incremental signals automatically provided to the vehicles as a function of vehicle passage and relative vehicle position. In addition central control is provided for such a system to allow for superimposing on the automatic wayside signal equipment a programmable speed control which allows for simultaneous provision of safe vehicle speed while establishing constant, acceleration or deceleration control over any vehicle in the system.

20 Claims, 10 Drawing Figures

SIGNAL SYSTEM FOR HIGH SPEED TRAINS

This invention relates to a vehicle speed signal system for vehicles traveling along a predetermined way.

More specifically this invention relates to a vehicle speed signal system for vehicles traveling along a predetermined way such as a track or other guideway wherein the system has at least two consecutive sections and a vehicle to be controlled by a vehicle speed control signal received by the vehicle from the wayside as the vehicle travels through each section. Each section of the predetermined way or track includes the following interrelated apparatus. A vehicle detector is arranged to detect the presence of a vehicle in the section and each vehicle detector is electrically connected to the next preceding section's vehicle detector. A controlled coupling unit is provided which is controlled by the section's associated vehicle detector. A vehicle speed signal generating unit is controllably coupled by the vehicle detector through the coupling unit respectively to a next preceding section and to a vehicle speed signal generating unit of a next preceding section to deliver a vehicle speed control signal to the preceding section only when the section of immediate concern is unoccupied and the next succeeding section is occupied. Finally there is provided for each section an incremental speed signal source which provides respectively a signal to the vehicle speed signal generating unit and to the coupling unit, the incremental speed signal being delivered through the coupling unit only when the section is unoccupied and the next succeeding section is occupied.

Today more than at any time in history has the need for efficient high speed rapid transist been required. As speeds of train systems find their design centered around the proposition that trains should be able to travel at speeds in excess of one hundred miles an hour and with speeds at twice this rate being attainable with present technologies, the most pressing problem faced by the railroad industry is the provision of fully automated train control for trains traveling at these tremendous speeds. It is not difficult to imagine the situation where a train traveling at 150 miles per hour is bearing down on another train which has stopped or possibly is just under way. The time of day may find but little light and the weather such that visibility is nil. The wayside signals of yesteryear which once provided a real measure of security for train and passengers no longer provides a useful answer to the safe operation of the train especially when speeds of the magnitude present in this example are to be reckoned with. Current technology allows for signals to be located in the cab of the train to give the engineer an indication of track conditions ahead. But is this enough? The invention to be described hereinafter contemplates in its very essence that this is not enough. In order that a train traveling at the speed in this example, i.e., 150 mph, may stop smoothly and with precision and comfort to the passengers, a stopping distance of 9600 feet would be normal, or so experts tell us. It must be kept in mind that throughout a vast high speed train system operating at maximum traffic density and minimum headway there would be a constant requirement to maintain a safe headway between trains and a relative speed between trains that would always ensure adequate braking time and distance by trains following one another. The system just described immediately impresses the mind of any reader of this specification that the system is a dynamic, pulsating creature frought with all the risks that enormous speeds and split second timing require. To meet and exceed the needs of this taxing environment the invention to be described more fully hereinafter provides a completely sophisticated answer that is rendered more significant by the simplicity of its application to existing railroads and exciting in its potential for all forms of high speed guideways of the future. The invention to be described sets forth a contribution readily attainable with current technology but so advanced as to embrace the expanding technology of solid state devices.

It should be recognized that while this invention is to be described in a railway environment of the type employing rails and conventional high speed trains, the invention equally embraces all modes of high speed transit such as air levitated vehicles, linear induction trains, and in fact any system, whether high speed or low, where a fixed guideway is involved.

It is therefore a primary object of this invention to provide a vehicle control system wherein wayside equipment automatically derives a train control signal which at a given instant is a measure of the safe speed for a vehicle to pass over a particular section of track or guideway.

Another object of this invention is to provide automatic speed control and train separation.

Yet another object of this invention is to provide a vehicle control system wherein the arrangement is passive and the mere presence of a vehicle moving or stopped instantly provides safe speeds for all other following vehicles.

Still another object of this invention is to provide incremental speed control in successive regions following every vehicle in the system.

Another object of this invention is to provide a high speed transit control system with central control that may be readily programmed to handle a variety of needs.

A further object of this invention is to provide a high speed transit control system that allows simultaneous constant speed and/or acceleration of any vehicle in the system from a central control station.

In the attainment of the foregoing objects an automatic speed control system is provided wherein a vehicle traveling through a plurality of predetermined sections of a fixed guideway has its speed controlled directly as a function of track occupancy ahead as well as a function of the changing rate of track occupancy ahead. In the preferred embodiment of the invention each section of the fixed guideway has a vehicle detector unit to detect the presence of a vehicle in the section and each vehicle detector unit is electrically connected to a similar unit in an adjacent section. There is in addition a coupling circuit which is controlled by the vehicle detector unit as well as a vehicle speed signal generating unit which is likewise controllably coupled by the vehicle detector unit through the coupling circuit respectively to the next preceding section and to a vehicle speed signal generating unit of a next preceding section to thereby deliver a vehicle speed control signal to the preceding section whenever the section is unoccupied and the next succeeding section is occupied.

Of major importance to the invention is an incremental speed signal source which provides respectively a signal to the vehicle speed signal generating unit as well as to the coupling circuit. It is significant that the incremental speed signal is delivered through the coupling circuit only when the section of instant interest is unoccupied and the next succeeding section is occupied.

As noted earlier, there is a detector unit for each section and this detector unit in the preferred embodiment includes a relay, which relay controls a plurality of electrical contacts located respectively in the vehicle speed signal generating unit and the coupling circuit to thereby provide control of the vehicle speed control signal as well as the incremental speed signal.

One means of carrying out the invention contemplates that the speed signal generating unit include a motor coupled to an alternator wherein the motor's speed is controlled by a vehicle speed signal from the next succeeding section to thereby drive the alternator at a speed directly proportional to the vehicle speed signal. The alternator has connected thereto the incremental speed signal, mentioned earlier, to thereby add to or subtract from the alternator output the incremental signal, all in a fashion to be described more fully hereinafter. The relationship of the vehicle speed signal and that of the incremental speed signal is significant in that by design the vehicle speed signal has a frequency directly proportional to a desired safe vehicle speed and the incremental speed signal has a frequency less than the vehicle speed signal.

In another embodiment of the invention the vehicle speed signal generating unit includes a vehicle speed signal filter to control the incremental signal delivered from the speed signal generating unit to thereby limit the maximum speed signal that may be delivered to the next preceding section's speed signal generating unit. This feature limits the maximum speed signal that may be applied to any section to a predetermined value set by the speed signal filter.

Another embodiment of the invention includes in addition to the speed filter of the basic preferred embodiment, a variation in the incremental speed signal source. In this arrangement the incremental speed signal source includes at least three speed signal outputs and at least one of the three incremental speed signal outputs provides a zero incremental speed control signal, which zero incremental speed signal is controllably coupled to the vehicle speed signal generating unit via the vehicle speed signal filter.

Still another embodiment of the invention that is provided in conjunction with the preferred embodiment of the invention contemplates a modification of the speed signal generating unit such that this unit includes at least two speed signal filter elements, one of which controls the incremental signal to the speed signal generating unit to thereby limit the maximum speed signal to be delivered to the next preceding signal generating unit, thereby assuring a maximum speed for the system embodying the invention. The other speed signal filter is arranged so that it acts in cooperation with the first mentioned filter to provide one of two different incremental speed signals over two different speed signal ranges. To this embodiment there may be added a variation in the construction of the incremental speed signal source so that this incremental speed signal source has at least four outputs and at least one of the four incremental outputs provides a zero speed output signal, which zero speed output signal is controllably coupled to the vehicle speed generating unit by one of the vehicle speed signal filters, while at least two of the remaining three incremental speed signals are different and thereby provide the speed signal generating unit with differing incremental speed signals for differing ranges of speeds. This last described embodiment has utility where, for example, the ranges of incremental speeds are uniform over an initial speed range but when a predetermined speed is attained the incremental changes in speed are of a smaller magnitude.

Another embodiment of the invention contemplates the use of a programmed central control station which operates in a fashion that allows for overall system control.

Other objects and advantages of the present invention will become apparent from the ensuing description of illustrative embodiments thereof, in the course of which reference is had to the accompanying drawings in which.

Figure 3A:
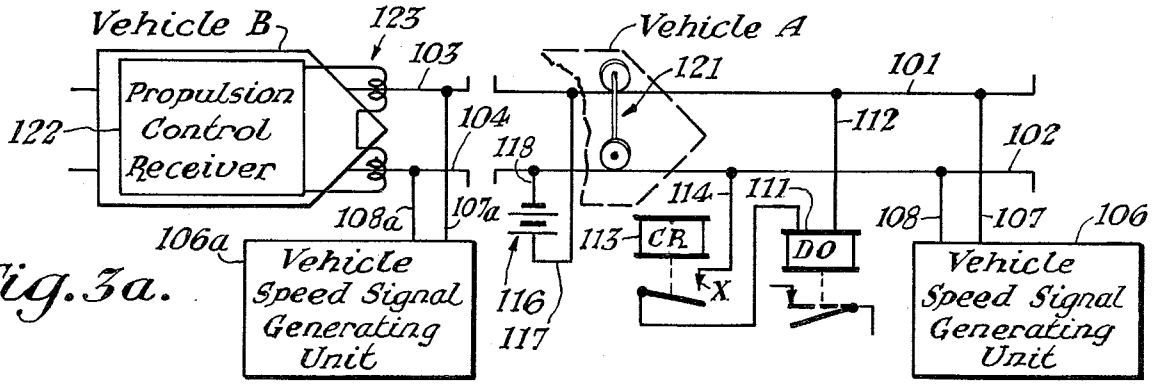
FIG. 3 is a circuit diagram depicting in detail one embodiment of the invention illustrated in FIG. 2.

FIG. 3*a* is a showing of the circuit detail of a typical train detection circuit suitable for use with the invention.

Figures 3, 3B:
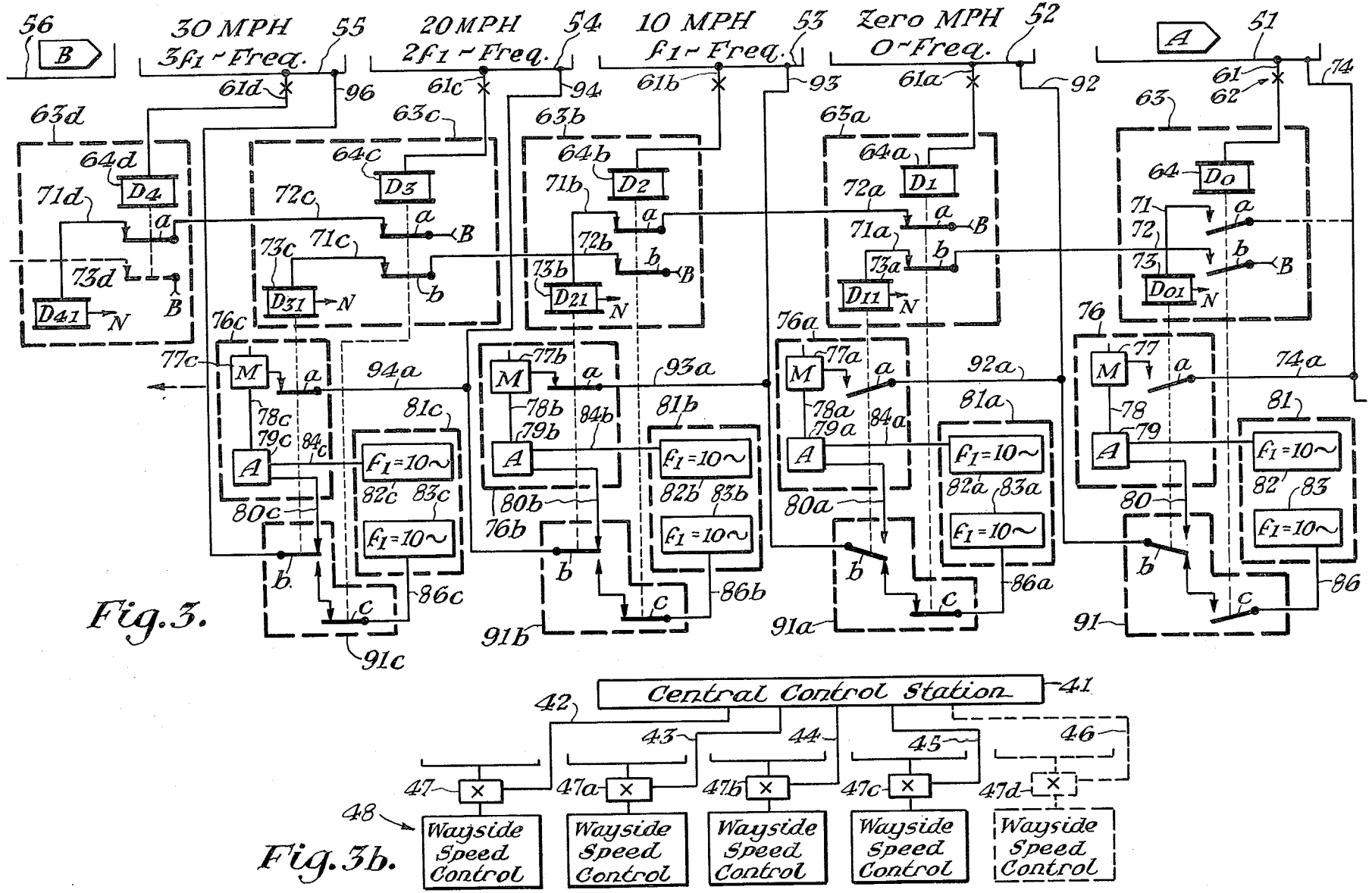

FIG. 3*b* is a block diagram showing central station control of a system embodying the invention.

Figure 4:
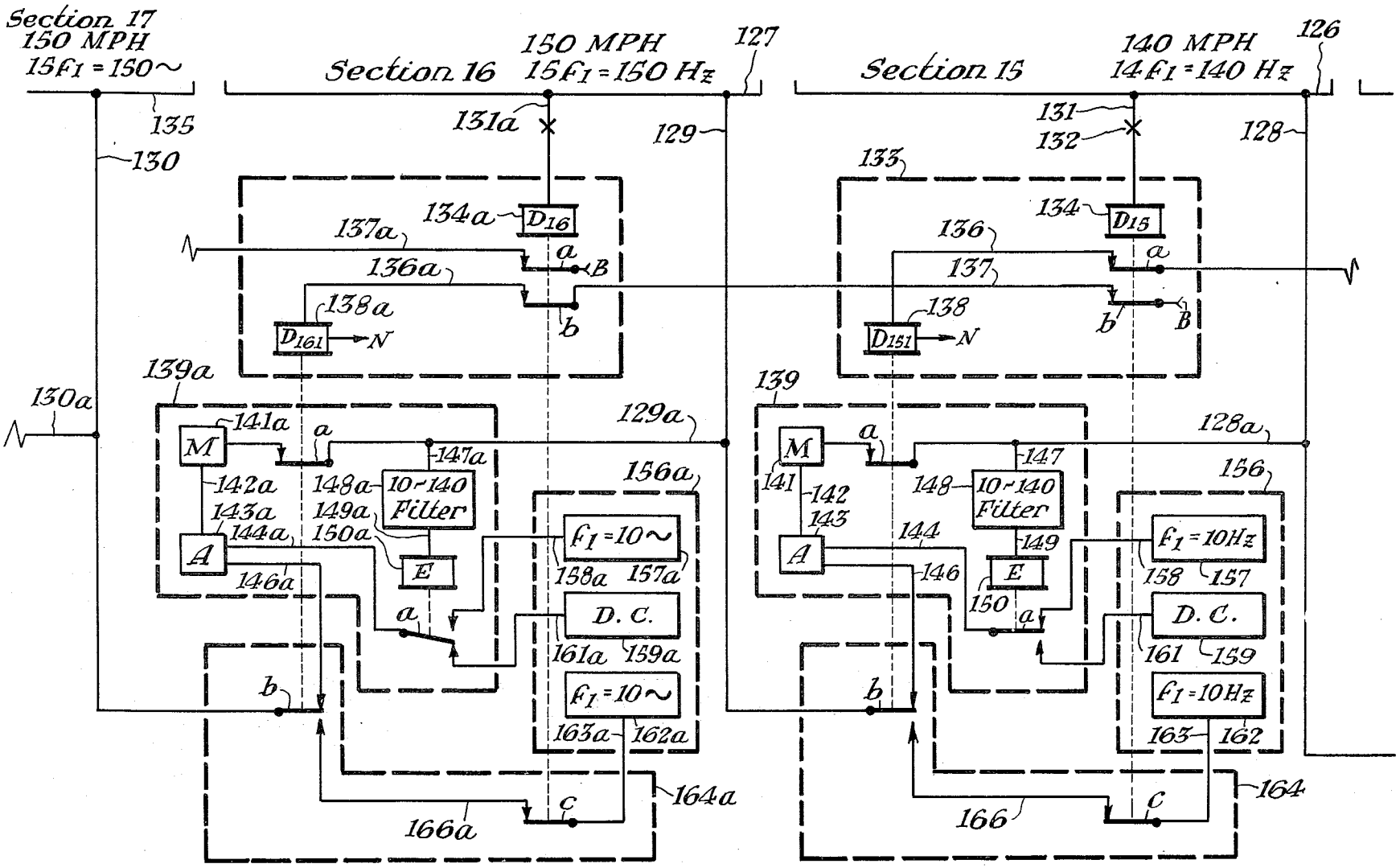

FIG. 4 depicts another embodiment of the invention in circuit diagram form wherein a maximum upper speed is provided.

Figure 5:
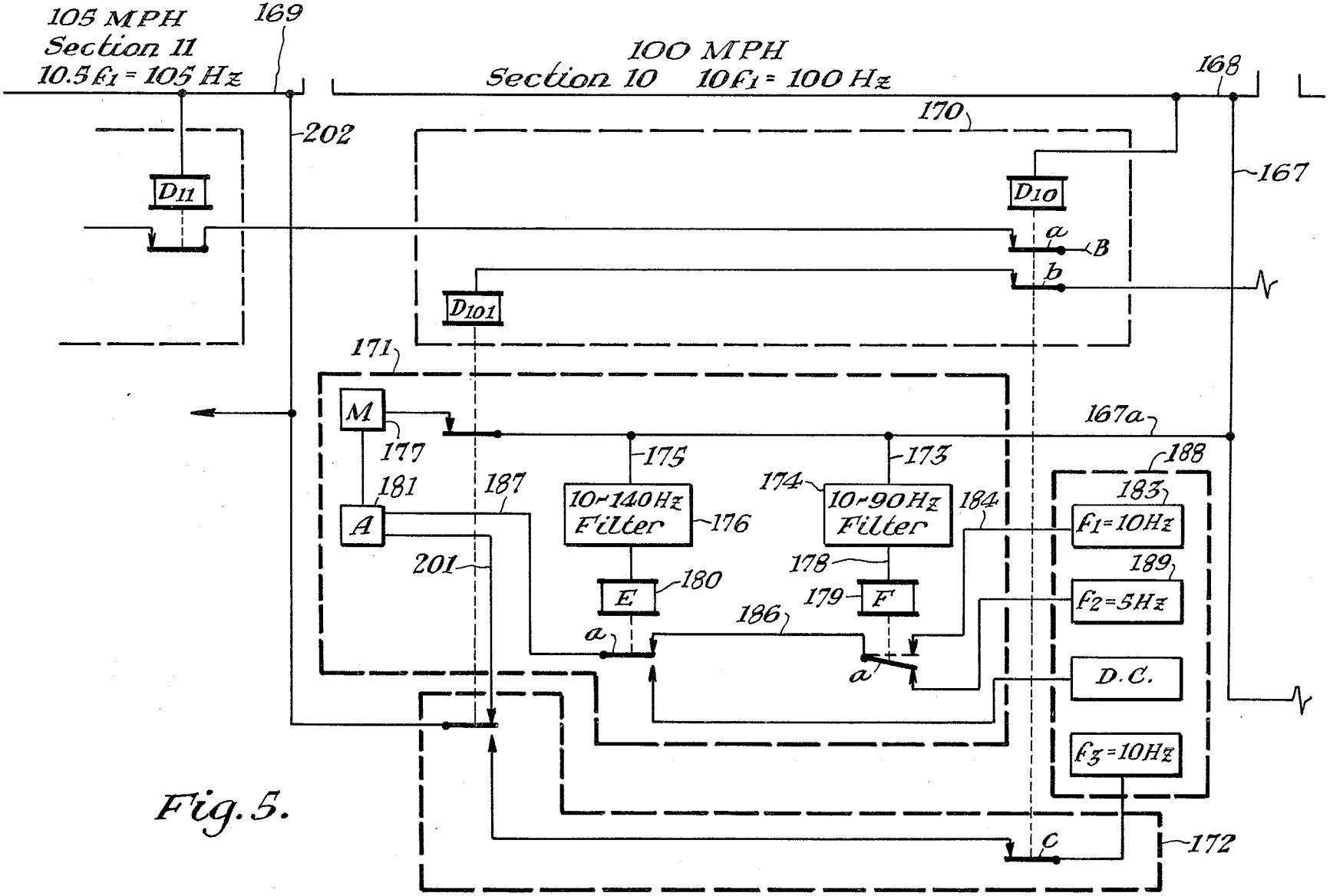

FIG. 5 is a circuit diagram of yet another embodiment of the invention in which there is provided differing incremental speed commands to control the maximum speed of a vehicle proceeding in a system embodying the invention.

Figure 6:
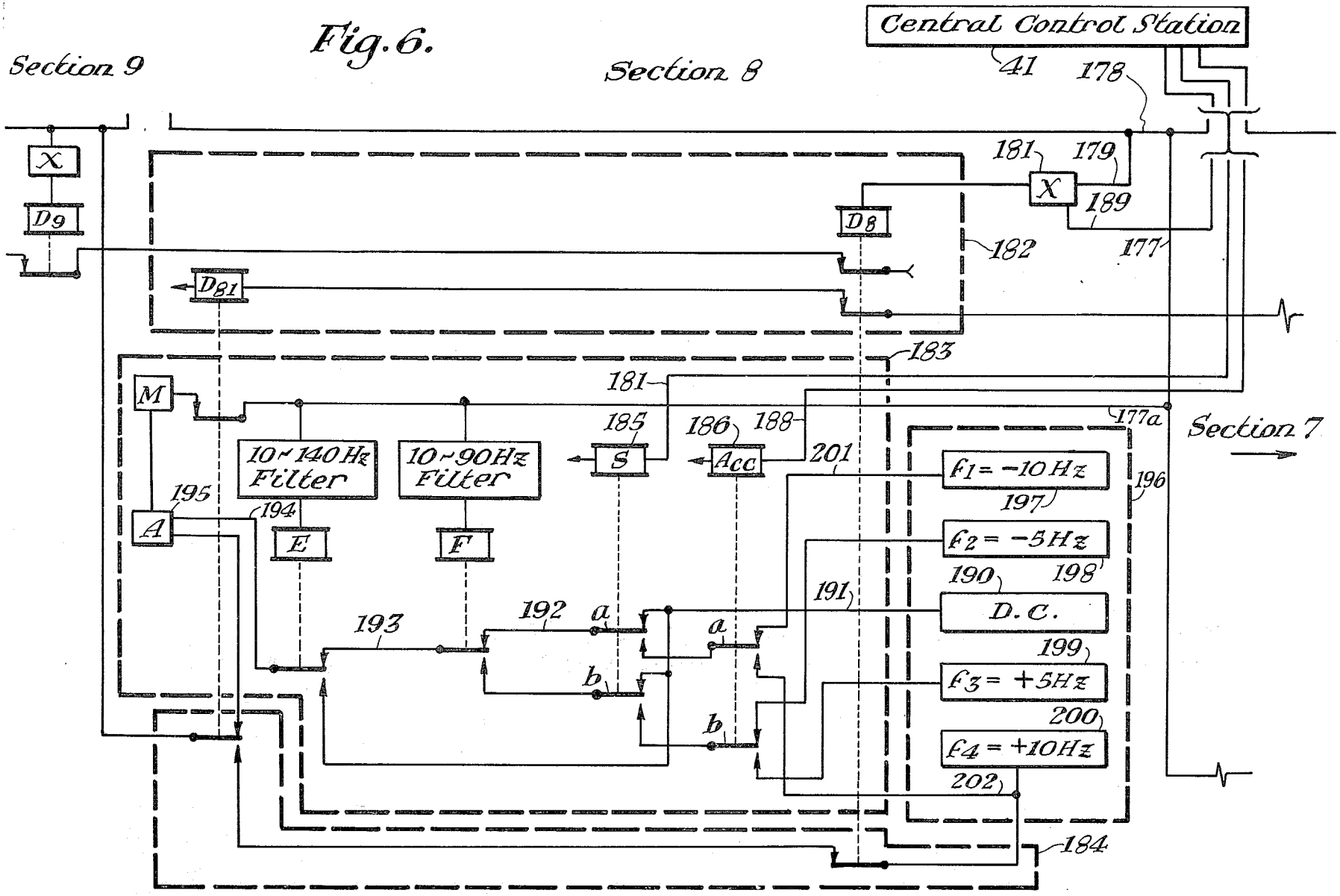

FIG. 6 is a circuit diagram of a system embodying the invention wherein circuitry is provided to allow for constant speed as well as acceleration.

Figure 7:
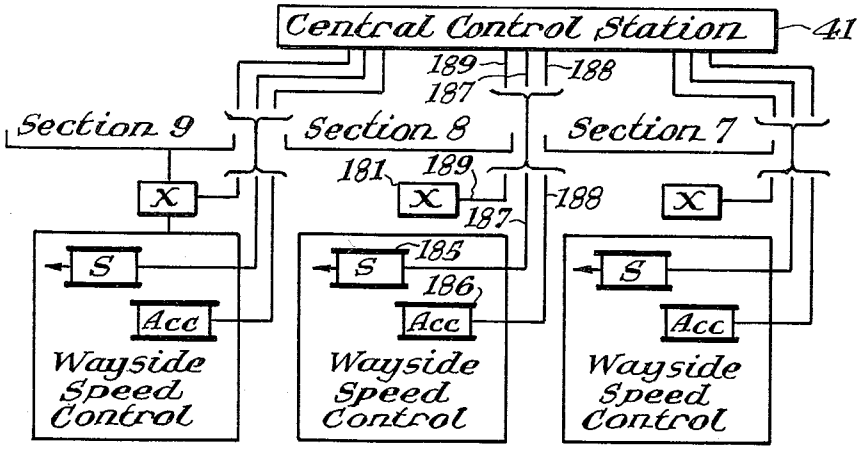

FIG. 7 is a block diagram of a system wherein there is illustrated the provision of central control to be employed in conjunction with the circuits of FIG. 6.

Figure 8:
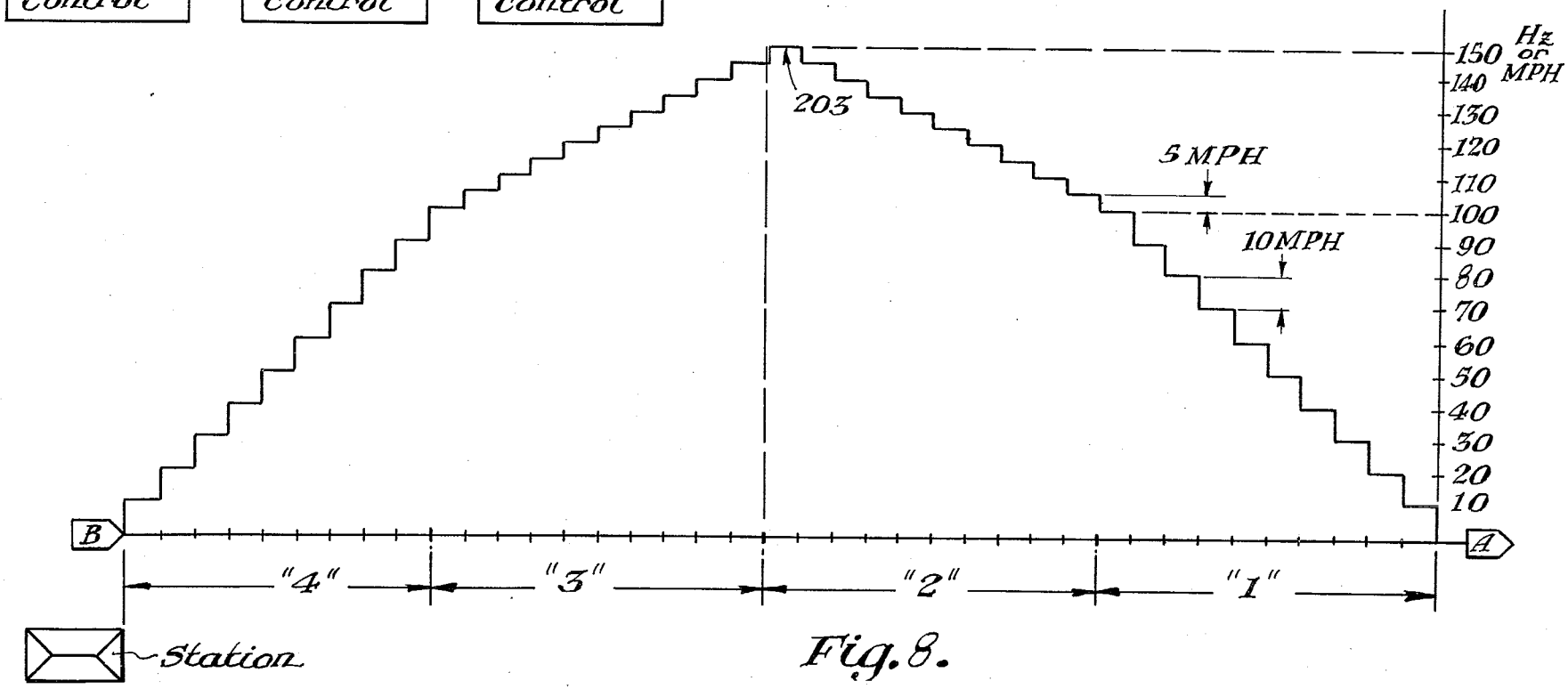

FIG. 8 is a graphic illustration of the dynamic speed relationship between two vehicles in a system that employs the circuits of FIG. 6 and overall system control of FIG. 7.

A description of the above embodiments will follow and then the novel features of the invention will be presented in the appended claims.

Figure 1:
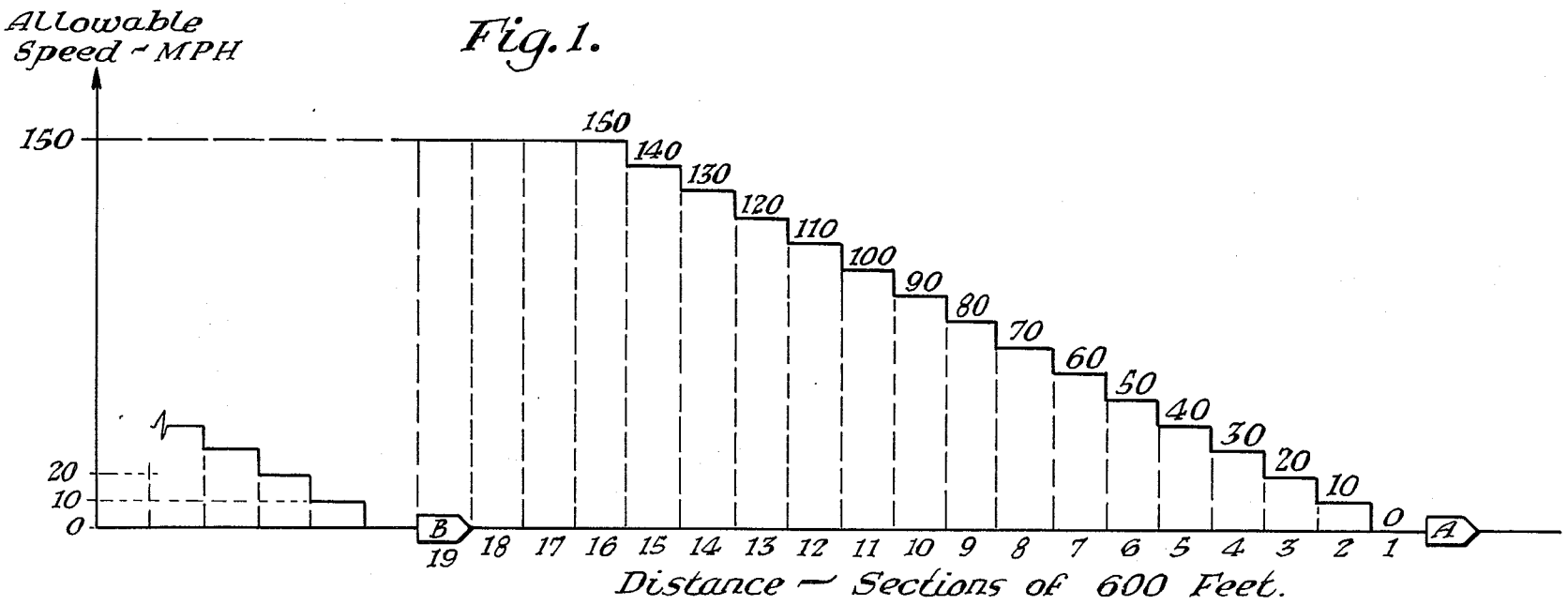
FIG. 1 shows a vehicle A followed by a vehicle B in schematic form.

Reference is now made to FIG. 1 which illustrates in graphic form a typical situation arising in transit environments. A train or vehicle A is shown on the right-hand side of the figure while a train or vehicle B is shown to the left and a distance away measured by predefined sections 1 to 18. As the system embodying the invention unfolds it should be kept in mind that at the heart of the invention there is a novel signal system for vehicles or trains which coperate over a track or guideway. The description that follows will apply to trains operating on tracks or to vehicles supported by an air cushion operating on a guideway; however, it should be kept in mind that the system is not limited to these modes of transportation. In fact the invention has utility in any system where objects proceed in consecutive fashion along a predetermined path and there is a desire that the movement of one does not physically conflict with another. It is of course anticipated that the predetermined path which may be conventional track, guideway or other arrangement, can be divided into sections, each of which is provided with equipment embodying the invention which determines whether the section is safe for the passage of a vehicle.

It should be noted that no novelty is claimed for the propulsion system of the vehicle or train but it is assumed that the speed of the train is controlled in response to a signal of some select frequency received from the wayside. The manner in which the wayside equipment derives the frequency and delivers it to the train is described in detail hereinafter.

A main fuction of the wayside equipment is to derive a frequency and provide a train or vehicle control signal which at a given instant is a measure of the safe speed for a train or vehicle to pass over a particular section of the track or guideway. In the specification that follows the term vehicle will be used throughout and wherever so used it should be understood that the term train or object may be substituted to thereby convey the manner of operation the reader may be contemplating. Much attention is currently being directed to air-cushioned vehicles and linear induction propelled cars operating on a guideway. Accordingly, these types of vehicles are given consideration throughout the specification even though not specifically referred to.

In order to describe the system's operation in a fashion that is logical and practical, it is desirable to assign some values to system parameters with the understanding that these values are merely for ease of explanation and demonstration and in no event are they intended to limit the invention described. With this thought in mind it is known that present technology indicates that it may be practical to detect an obstacle or a vehicle on a guideway section 600 feet in length. The techniques for detecting the presence of a vehicle are admittedly old and numerous and do not per se form a novel portion of the invention to be described. These train detection techniques include techniques that involve induction, radar, optics, and even the lasser. The invention contemplates that there be a device associated with each of the aforementioned sections which is capable of taking one position when the section is safe for the passage of the vehicle and another position when it would be unsafe for the passage of the vehicle.

Hypothetically let us assume 150 mph as the maximum vehicle speed permitted in the system under consideration and that a distance of 9600 feet of 16 sections of 600 feet each represents the distance in which a vehicle may be brought to a stop, with a safe margin, from 150 mph. As noted earlier, FIG. 1 shows a vehicle A followed by a vehicle B with 18 sections separating the two vehicles. The maximum permissible speed is indicated by section and is illustrated on the graph superimposed in the space between the vehicles in this FIG. 1. The speed is shown to be zero (0) in the first section at the left of the section occupied by vehicle A. The second section, to the left of the occupied section, has a speed limit of 10 mph; the third 20 mph; and so forth to the 16th section which has a speed limit of 150 mph. Accordingly, vehicle B, shown in the 19th section, is receiving a speed command indicative of 150 mph. If vehicle A were to remain stationary, vehicle B could advance through sections 19, 18, 17 and 16 at the maximum authorized speed of 150 mph. Upon entering the 15th section at a speed of 150 mph, the invention incorporated in the wayside equipment would allow a speed command indicative of a speed limit of 140 mph. Upon entering the 14th section the wayside equipment would automatically provide a speed command of 130 mph and so on down to zero (0) speed or stop in the section immediately at the left of the section occupied by vehicle A. This descending pattern of speed control is illustrated in the stepped graph of FIG. 1.

In accordance with the invention to be described more fully hereinafter, as the vehicle B moves to the right the wayside equipment in cooperation with the movement of vehicle B establishes speed limits in sections to the left of it in the same sequence as those to the left of vehicle A. It can therefore be observed that the system to be described provides a dynamic moving speed control arrangement which always will provide a pattern of vehicle speed control signals to the rear of the moving vehicle such that a following vehicle may proceed at some optimum speed up to a point where a reduced speed will be necessary to allow for a safe reduction in vehicle speed and distance between vehicles to thereby prevent collision between any two vehicles proceeding through the system.

It should be recognized that with speeds contemplated at 150 mph and even higher the use of conventional wayside signals which require visual contact are not practical from a number of standpoints. The costs of these signals are large and even more persuasive of their elimination is that at high speeds it would be extremely difficult, if not impossible, to observe the wayside signals accurately, particularly under adverse weather conditions. Accordingly, this invention contemplates that the signal, indicating maximum authorized speed at any instant, would appear in the vehicle in form of a conventional cab signal. This signal would be observed by the driver, or in the absence of a driver, the signal would be an input to an automatic driver or vehicle propulsion control unit.

At the heart of the invention concept employed in the invention to be described is the principle of conveying speed control information to the vehicle indicative of the maximum safe speed at which it may proceed. This maximum safe speed signal is obtained by deriving a frequency from wayside equipment and then transmitting that frequency to the vehicle for control of the vehicle's speed. The derived frequency has a value which inherently takes into account the relative distance the vehicles are apart and their respective speeds. One example of transmission of information from the wayside to the vehicle may be by induction from wire loops installed in the guideway. If the vehicles operate on metallic rails, the speed control information could be transmitted to the rails and then picked up inductively by receiving equipment on the vehicle. It should be kept in mind that a radio link between wayside and vehicle is another possibility if there can be made available space on the already crowded frequency spectrum. In addition the wave guide may well be an attractive approach for the transmission of a maximum safe speed signal especially where there is a further desire to have a television capability on board the vehicle.

In order to go forward with a detailed explanation of the various embodiments of this invention in a manner that simplifies the description let there be the following assumption made. The frequency in hertz ($H_z$) transmitted to a vehicle will call for the operation of the vehicle at a corresponding speed in miles per hour (mph). For example, a speed control signal of 100 $H_z$ calls for a maximum permissible speed of the vehicle of 100 mph.

It should be kept in mind that while the above relationship is utilized for purposes of explanation the relationship is in no way intended to be limitative of the invention to be described. It is also recognized that the description that follows sets forth the provision of distinctive frequencies for speed commands; however the invention contemplates that for purpose of avoiding self oscillation of the receiving equipment on the vehicles the speed command signal could be modulated. Accordingly, modulation of the command frequency signals would allow the user of the invention an added margin of safety. This specification will not detail the state-of-the-art frequency modulating schemes that have in many, a fail-safe capability. Leave it to say that the invention in respect of modulation of frequency signals contemplates that degree of modification that falls within the purview of the appended claims.

Figure 2:
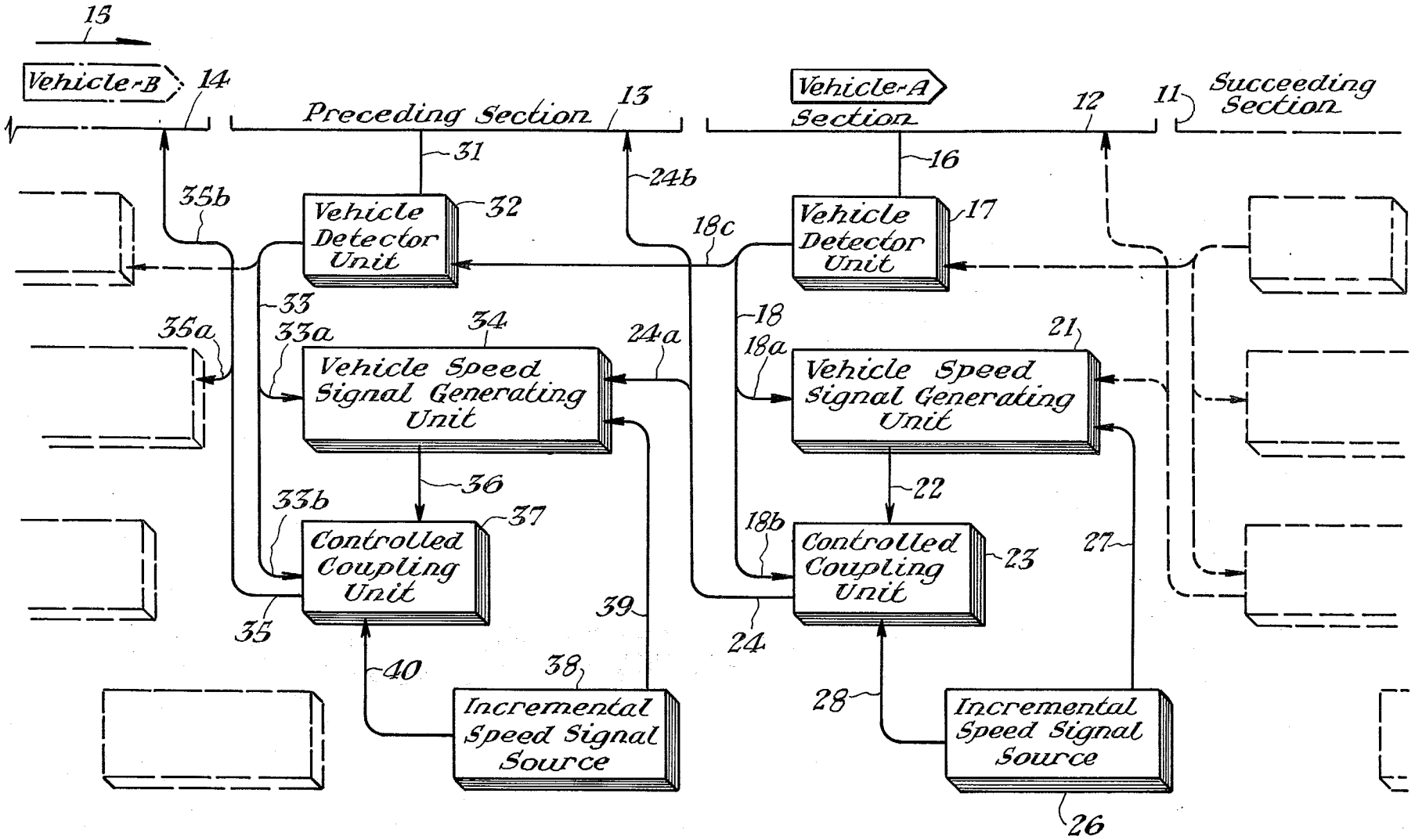
FIG. 2 illustrates in block diagrammatic form a generalized embodiment of a system embodying the invention.

Reference is now made to FIG. 2 which illustrates in block diagram form a generalized embodiment of the invention in which the major components and their interrelation can be perceived. The remaining figures and their description will provide in expanding detail the various embodiments of the invention.

In this figure only the details for two typical sections of guideway are shown and are designated by bracket segments 12, 13 while two other sections 11 and 14 are shown in broken lines. Bracket segment 12 is titled SECTION and has positioned thereabove an oblong block designated "Vehicle A". Bracket segment 13 is titled PRECEDING SECTION and broken line bracket segment 11 is titled SUCCEEDING SECTION. Broken line bracket segment 14 has positioned thereabove, also shown in broken line, an oblong block titled "Vehicle B". It will be observed that each section has shown thereunder four major components. For example, in the SECTION under Vehicle A there is a vehicle detector unit 17 shown operatively connected via coupling 16 to the bracket 12 as well as to the vehicle detector unit 32 of the bracket segment 13 titled PRECEDING SECTION. The vehicle detector is electrically connected to the next preceding vehicle detector unit 32 via controlled coupling 18*c*. Shown beneath the vehicle detector unit 17 is a vehicle speed signal generating unit 21 which is shown connected to the vehicle detector unit 17 via controlled coupling output 18, 18*a*. Positioned beneath the vehicle speed signal generating unit 21 is a controlled coupling unit 23 which is mutually controlled by outputs 18, 18*b* from the vehicle detector unit 17 as well as output 22 of the vehicle speed signal generating unit. The final component shown in the section under Vehicle A is an incremental speed signal source 26 which has a pair of outputs 27, 28 to provide incremental signals to the vehicle speed signal generating unit 21 and the controlled coupling unit 23.

In a like fashion bracketed segment 13 titled PRECEDING SECTION has a vehicle detector unit 32 operatively connected via coupling 31 as well as a controlled coupling output 33, 33*a*, 33*b* connected respectively to vehicle speed signal generating unit 34 and controlled coupling unit 37. A controlled coupling unit 37 has an output 35, 35*a* and 35*b* delivered to the components shown in the section in which Vehicle B is shown positioned. An incremental speed signal source 38 has outputs 39, 40 feeding the vehicle speed signal generating unit 34 and the controlled coupling unit 37, respectively.

The system illustrated in FIG. 2 is intended to show a signal system for vehicles such as Vehicle A and Vehicle B which are traveling along a predetermined way defined by sections made up of bracket segments 11, 12, 13, 14 with the direction of travel shown by arrow 15. In this figure Vehicle A is shown stopped and Vehicle B is shown moving and under control of speed control signals delivered to each section by outputs 24*b* and 35*b* from controlled coupling units 23, 37, respectively. Vehicle B would receive a control signal over output 35 while in the position shown and upon movement into the section titled PRECEDING SECTION its speed would be controlled by the speed control signal delivered by output 24. Each of the vehicle detectors 17, 32 detects a vehicle in its respective section and this presence or absence is conveyed to the preceding section's vehicle detector unit.

Each section's incremental vehicle speed signal generating unit is uniquely arranged to deliver a vehicle speed control signal to the preceding section only when that particular section is unoccupied and the next succeeding section is occupied.

The incremental speed signal source 26, for example, provides respectively an incremental signal to the vehicle speed signal generating unit 21 via output 27 and to the coupling unit 23 via output 28. This incremental speed signal is delivered in the practice of this invention through the coupling unit 23, to control the speed of a vehicle in the preceding section via output 24, 24*b* only when the section is unoccupied and the next succeeding section is occupied.

Referring now to FIG. 3 in which a detailed circuit arrangement is provided which illustrates one embodiment of the invention where a safe speed control frequency signal is derived from the wayside equipment.

In the right-hand side of the figure is shown a Vehicle A positioned in rail section 51 and on the left-hand side there is a Vehicle B positioned in rail section 56. Between the two vehicles A and B are rail sections 52, 53, 54, and 55. Each of these sections is in accordance with the invention determined as being safe for the passage of a vehicle. Positioned beneath each of the rail sections 51, 52, 53, 54 and 55 there is illustrated the circuit detail shown by the block diagram of FIG. 2. It should be noted that each of the major components of FIG. 2, which were there shown in solid line form, is depicted in FIG. 3 in broken line. Accordingly there is shown a vehicle detector unit 63 positioned in respect of rail section 51 while to the left thereof is illustrated similar vehicle detectors 63*a*, 63*b*, 63*c* and 63*d* located beneath rail sections 52, 53, 54, and 55, respectively.

In like fashion there is shown positioned beneath rail section 51 a vehicle speed signal generating unit 76 while located beneath rail sections 52, 53 and 54 there are vehicle speed signal generating units 76*a*, 76*b* and 76*c*.

Similarly an incremental speed signal source 81 is positioned in respect of rail section 51, as shown, and each of the rail sections 52, 53 and 54 has incremental speed signal sources 81*a*, 81*b* and 82*c*.

The last major component is that designated as controlled coupling unit 91 and each of the remaining rail sections 52, 53 and 54 has illustrated comparable controlled coupling units 91*a*, 91*b* and 91*c*.

A study of the content and operation of the major components associated with rail section 51 will now be provided, followed by the operation of the vehicle detection arrangement of FIG. 3*a* and finally the system operation wherein all the major components are involved.

The vehicle detector unit 63 includes a detecting relay $D_o$ referenced 64, which relay 64 is electrically connected to rail section 51 through lead 61 and an X contact 62. The operation and construction of the vehicle detection relay arrangement is not put forward as part of the novel contribution of this invention. The vehicle detection circuit arrangement will be explained more fully hereinafter in conjunction with the showing of FIG. 3*a*. The relay $D_o$ is shown in its released position in response to a Vehicle A occupying rail section 51. $D_1$ to $D_4$ relays 64*a*, 64*b*, 64*c* and 64*d* are shown picked up indicating that their sections are safe for the passage of a vehicle. Also included in vehicle detector unit 63 is a $D_{ol}$ relay 73 having a lead 71 and a front contact *a* of $D_o$ relay 64 controllably associated therewith. $D_{ol}$ to $D_{41}$ relays 73, 73*a*, 73*b*, 73*c* and 73*d* when in a picked-up position, indicate that two consecutive sections are safe for passage of a vehicle. It will be observed that $D_o$ vehicle detecting relay 64 controls a pair of contacts *a* and *b* in the vehicle detecting unit 63 as well as a contact *c* in the controlled coupling unit 91. $D_{ol}$ relay 73 controls a pair of contacts, one of which *a* is located in the vehicle speed signal generating unit 76 and the other contact *b* is located in the controlled coupling unit 91. Accoringly, the controlled coupling unit 91 is mutually controlled by the relays 64, 73 of the vehicle detecting unit 63. It can be readily seen that each of the circuit arrangements for the respective rail sections 52, 53 and 54 is similarly arranged and operates in accordance with the mode of operation set forth with regard to rail section 51.

The vehicle speed signal generating unit 76 has shown in rectangular boxes containing the letters M and A what is to be referred to as a motor 77 and alternator 79 arrangement in which the motor 77 has a shaft 78 connection to the alternator 79. The motor may be either an induction motor or a synchronous motor, the speed of which is proportional to the frequency by which it is energized. The alternator 79 is arranged so it will deliver the same frequency as that which energizes the motor 77 if the field of the alternator is energized by direct current. In this arrangement, however, the field of the alternator is a two or three phase field that rotates in response to the energization of a frequency $f_1$ delivered from the incremental signal source 81 via lead 84. This field rotates in a direction opposite to the mechanical rotation of the motor of the alternator 79. The frequency induced in the rotor of the alternator 79 is responsive to the sum of these two speeds of rotation. This frequency induced in the rotor is delivered over lead 80 to the controlled coupling unit 91. The increment speed signal source is shown for purpose of illustration only as having a pair of $f_1$ frequency signal producing units 82 and 83 connected respectively by leads 84, 86 to the vehicle speed signal generating unit 76 and controlled coupling unit 91. It can be appreciated that a single $f_1$ source is all that is required.

Before going forward with an explanation of the operation of the system illustrated in FIG. 3 attention will be briefly given to the arrangement shown in FIG. 3*a* which depicts the basic circuit elements necessary for vehicle detection in a railway environment. In this figure a pair of vehicles A and B have been schematically shown positioned on rails 101, 102 and 103, 104, respectively. The rails 101, 102 have delivered thereto from a battery 116 via leads 117, 118 power to control $D_o$ relay 111 over lead 112 and the X contact of CR relay 113 and lead 114 to rail 102. In the absence of a vehicle A, the battery 116 will maintain the $D_o$ relay 111 energized provided the CR relay 113 (to be described hereafter) is energized and has its front X contact closed. When a vehicle such as A partially illustrated with its associated wheels and axles 121 is present and shunts the rails, the rails 101, 102 of the circuit between the battery 116 and the $D_o$ relay 111 is interrupted and the $D_o$ relay 111 is deenergized. In order to provide an additional perspective to facilitate the understanding of the overall scheme of the inventive arrangement a vehicle speed signal generating unit 106 is shown connected across the rails 101, 102 by leads 107, 108 to provide a vehicle speed command to the rails to be picked up by a vehicle passing thereover. Vehicle A has been shown without any receiving coils or on-board equipment but is should be understood that the Vehicle A would be equipped in a like fashion as Vehicle B in that there would be, as shown associated with Vehicle B, a propulsion control receiver 122 having a pair of receiving coils 123 positioned over the rails to receive a vehicle speed command from a wayside vehicle speed signal generating unit 106*a* connected across the rails 103, 104 by leads 107*a*, 108*a*.

As noted earlier there is shown in both FIG. 3 and FIG. 3*a* an X contact designated by reference numeral 62 in FIG. 3 and by the CR relay 113 and X contact in FIG. 3*a*. The X contact shown between each detecting relay, e.g., $D_o$ relay 64, and its rail section, e.g., rail section 51, represents the front contact of a CR relay 113 (see FIG. 3*a*) controlled from a control center. The function of the control center will be set forth more fully with regard to vehicle stopping and overall system control to be discussed more fully hereinafter. Suffice it to say at this point without going into the details of the remote control of this X contact that a considerable control of the speed of a vehicle may be exerted by the programming of the opening and closing of the contacts X ahead of a vehicle. It will become obvious that to stop a vehicle at a particular section it is only necessary to open the contact X of the desired section. To control the speed of a vehicle at some value less than normally permitted by the system, the open contact X could be selected the desired number of sections ahead of the train and programmed from section to section at a desired rate.

The operation of system of FIG. 3 is as follows: The presence of a vehicle A in rail section 51 causes the $D_o$ relay 64 to be released in response to the vehicle being in its section. The release of $D_o$ relay 64 causes the release of $D_{ol}$, $D_{11}$ relays 73, 73*a* because the front contact *b* of $D_o$ relay 64 is opened, thereby interrupting the B battery source from lead 72 which is connected over front contact *b* of $D_1$ relay 64*a*, lead 71*a* to $D_{11}$ relay 73*a*. The function of the remaining components in respect of this section should be observed at this time.

As a result of the vehicle A's presence in rail section 51 there will be zero (0) frequency speed signal given rail section 52 over lead 92 from the controlled coupling unit 91 due to the fact that, while the back contact *b* of $D_{ol}$ relay 73 is closed, the front contact *c* of $D_o$ relay 64 is open, thereby preventing the delivery from the incremental signal source 81*a* of an $f_1$ frequency signal over lead 86 from $f_1$ source 83. In the explanation of this figure the incremental speed signal has been hypothetically set at 10 $H_z$ to provide an equivalent 10 mph incremental speed increase.

As noted above there is a zero (0) frequency speed signal condition present on lead 92 which also establishes the same condition on branch lead 92*a* to the vehicle speed signal generating unit 74*a*. However the front contact *a* of $D_{11}$ relay 73*a* is open and no signal is delivered to motor 77*a*.

Because there is no vehicle present in rail section 52, $D_1$ relay 64*a* remains energized maintaining closed its front contacts *a*, *b*, *c*. With front contacts *a*, *b* and *c* of $D_1$ relay 64*a* closed, two circuits are now completed. With front contact *a* of $D_1$ relay 64*a* closed a first circuit is completed as shown from B point over contact *a*, lead 72*a*, front contact *a* of $D_2$ relay 64*b*, lead 71*b* to $D_{21}$ relay 73*b* to thereby energize $D_{21}$ relay 73*b* and allow completion of circuits in vehicle speed signal generating unit 76*b* and controlled coupling unit 91*b*.

A second circuit is completed between the incremental speed signal source 81*a*'s $f_1$ frequency source 83*a*, lead 86*a*, front contact *c* of $D_1$ relay 64*a*, back contact *b* of $D_{11}$ relay 73*a* to leads 93 and 93*a*. Lead 93 delivers to rail section this incremental speed frequency $f_1$ of 10 $H_z$ to rail section 53 and therefore provides a safe speed command to this section of 10 mph. The $f_1$ signal of 10 $H_z$ is also delivered to the motor-alternator arrangement 77*b*, 78*b*, 79*b* of the vehicle speed signal generating unit 76*b* of the next preceding section.

The presence of the $f_1$ frequency signal of 10 $H_z$ on leads 93*a* causes the motor 77*b* to be driven at a speed proportional to the $f_1$ frequency which in turn drives the alternator 79*b* at this speed through shaft 78*b*. It can also be seen that the incremental speed signal source 81*b* and its $f_1$ frequency supply 82*b* deliver to alternator 79*b* over lead 84*b* the $f_1$ frequency of 10 $H_z$. The rotating magnetic field of the alternator is also due to the $f_1$ frequency. The output of the alternator therefore has a frequency of $2f_1$ and is connected to rail section 54 via lead 80*b*, front contact *b* of $D_{21}$ relay 73*b* and lead 94. Accordingly, rail section 54 has now indicated an allowable safe speed of 20 mph which is equivalent to $2f_1$.

In a similar fashion, as described with reference to rail section 53, we can see that the motor alternator arrangement of the vehicle speed generating unit 76*c* has delivered this $2f_1$ frequency over lead 94*a*. It is apparent from this FIG. 3 that rail section 55 receives via the circuitry shown a vehicle control signal of $3f_1$ or 30 mph.

In a similar manner to that which has been described the frequency and therefore signal for the speed of an advancing vehicle increase in accord with the number of safe sections ahead. In the fashion outlined above where we have hypothetically assigned a value of 10 to the frequency $f_1$, it becomes obvious that the equipment of FIG. 3 implements the step diagram of FIG. 1 where there are 16 or less safe sections ahead of Vehicle B. The wayside equipment of FIG. 3 would permit the step-by-step increase for each safe section of 17 and beyond in FIG. 1. In the example described with reference to FIG. 1, it has been assumed 150 mph as the maximum permitted speed of the vehicle.

The description that follows is a modification of the system of FIG. 3 so that section 17 of FIG. 1 and succeeding sections never receive a frequency greater than 150 $H_z$.

FIG. 4 illustrates the circuit detail of the just above-noted modification. In most respects FIG. 4 is the same as FIG. 3 except provision has been made to limit the maximum frequency to any section to 150 $H_z$. Two full sections are shown which in FIG. 1 would be sections 15 and 16 to the left of Vehicle A. These and all intervening sections are assumed to be safe for the passage of a vehicle.

Section 15 is comprised of a rail section 126 as well as the basic components enumerated in FIG. 3. These components consist of vehicle detector unit 134 electrically connected via X contact 132 and lead 131 to rail section 126, as well as $D_{15}$ vehicle detection relay 134. As was noted earlier with reference to this group of vehicle detection relays, the absence of a vehicle from the section allows the $D_{15}$ relay 134 to remain energized with its front contacts *a*, *b* and *c* completing circuits in the vehicle detector unit 133 and the controlled coupling unit 164. It will be noted that the vehicle speed signal generating unit 139 is modified to include a band pass filter 148 having a range between 10 and 140 $H_z$. The band pass filter 148 is connected via lead 147 to lead 128*a*, which last mentioned lead has thereon a frequency of 140 $H_z$ which provides section 15 with an equivalent 140 mph command signal. The band pass filter 148 is also connected via lead 149 to E relay 150. The function of E relay 150 is significant in that it controls the delivery over its front and back contacts *a* of one of two different signals from the incremental signal source 156. There has been added in this embodiment to the incremental signal source 156 a d.c. power source 159 in addition to a pair of $f_1$ frequency sources 157, 162. The d.c. power source 159 is shown with an incomplete circuit to alternator 143 due to the opened back contact *a* of E relay 150 interrupting the circuit between leads 161 and 144. Had the E relay 150 been deenergized then the d.c. power source would have been connected over the circuit just described to the field of the alternator 143 and there would not be a step up in frequency of its output.

It will be noted that section 15 is receiving 140 $H_z$ over lead 128. This same frequency is also delivered to motor 141 via lead 128*a* and front contact *a* of $D_{151}$ relay 138. Note also that this same frequency is also delivered directly to the 10–140 $H_z$ filter 148 over lead 147. Since 140 $H_z$ is within the band of the filter, the E relay 150 is energized via lead 149 and picks up, thereby completing a circuit from $f_1$ source 157, lead 158, front contact *a* of E relay 150, lead 144 to alternator 143. Alternator 143 is therefore energized with 10 $H_z$ and thus the output frequency of the alternator 143 associated with section 15 appearing on lead 146, front contact *b* of $D_{151}$ relay 138, and lead 129 to rail section 127 of section 16 is 150 $H_z$. As just noted the frequency of 150 $H_z$ is applied to section 16 control of the permissible speed for the vehicle as well as to lead 129*a* which in turn delivers this signal to the motor 141*a* of the vehicle speed signal generating unit 139*a*. In a fashion similar to that described with reference to section 15 the 150 $H_z$ signal is also delivered directly over lead 129*a*, 147*a* to 10–140 filter 148*a*. Since, however, the 150 $H_z$ signal is outside the band of the 10–140 $H_z$ filter 148*a*, E relay 150*a* receives no energization over lead 149*a* from 10–140 $H_z$ filter 148*a* and E relay 150*a* is in its released position. With E relay 150*a* deenergized a circuit is thus completed from d.c. source 159*a* of incremental speed signal source 156*a* via lead 161*a*, back contact *a* of E relay 150*a*, lead 144*a* to the field of alternator 143*a*. Accordingly, there will be no step up in frequency of the alternator 143*a* output on lead 146*a* which in turn will limit the safe speed signal delivered via front contact *a* of $D_{161}$ relay 138*a* and lead 130 to the rail section 135 of section 17. The frequency of 150 $H_z$ is therefore applied to section 17 where the operation would be the same as for section 16 and would result in 150 $H_z$ to section 18 not shown.

It is apparent that the modification just described allows for the establishment of a maximum permissible speed as described in the example of 150 mph and this would hold true without regard to how many sections of rail or guideway were involved.

It is recognized that at vehicle speeds greater than, say 100 mph, it may be that 10 mph decrease in speed for each 600 feet of distance is greater than may be achieved with practical braking. If induction motors, either rotary or linear, are used for propulsion, it is usually desirable to keep the energizing frequency reasonably near to that corresponding to the speed of the vehicle, above for acceleration and below for retardation. If in fact this is the desired performance, then 5 mph steps may well be provided for vehicle speeds greater than 100 mph. To accomplish this end the cirucit modification illustrated in FIG. 5 may be employed.

Reference is now made to FIG. 5 which for the most part is similar to FIG. 4 except that an additional band pass filter has been added to the vehicle speed signal generating unit 171. For purposes of illustration it is assumed that section 10 of FIG. 1 is selected as that section where the transition from 10 mph increments to 5 mph will be demonstated. As in earlier figures this section 10 has a rail section 168 and the preceding section has a rail section 169. In the case of rail sections 168 there is a lead 167 from the wayside equipment of the succeeding section which has imposed thereon a signal of 100 $H_z$ indicative of 100 mph. No discussion will be provided concerning the vehicle detecting unit 170 other than to note in all embodiments this unit functions in the same fashion. It will also be noted that the controlled coupling unit here designated by reference numeral 172 also functions in the same fashion as in all other embodiments of the invention and its detail will not be redescribed here. As was noted at the outset of the description of FIG. 5 an additional filter has been added to vehicle speed signal generating unit, namely, 10–90 $H_z$ band pass filter 174, electrically connected to lead 167*a* via lead 173, lead 167*a* having imposed thereon the 100 $H_z$ frequency signal noted earlier. Accordingly, the 10–90 $H_z$ band pass filter receives the 100 $H_z$ signal simultaneously with the 10–140 band pass filter 176 over leads 167*a*, 175. The motor 177, as in the other embodiments, also receives the same signal as that delivered to the rail section of the section under study. The 10–90 $H_z$ band pass filter 174 is electrically connected via lead 178 to F relay 179. In the event that a signal on lead 167*a* were in the range of 10 to 90 $H_z$, e.g., 70 $H_z$, it is clear that E relay 180 and F relay 179 are energized and the *a* contact of E relay 176 is in the picked-up position shown while the *a* contact of F relay 179 is in the dotted line position shown. With the relays E and F both in the picked-up position, the field of the alternator 181 is energized by a 10 $H_z$ frequency signal from $f_1$ frequency source 183 over lead 184, front contact *a* of relay 179, lead 186, fronts contact *a* of E relay 180, and lead 187.

In order to appreciate this modification of the invention assume now that a frequency of 100 $H_z$ is being received from the section at the right. This frequency outside the 10–90 $H_z$ band of filter 174 results in the release of F relay 179, while the E relay 180 would remain energized. It should be noted that the incremental speed signal source 188 has added an $f_2$ frequency source 189 having a frequency value selected at 5 $H_z$. With F relay 179 released and E relay 180 picked up in the manner shown in FIG. 5, the alternator 181 is energized with 5 $H_z$ and the output frequency delivered to the rail section 169 of the next section 11 via lead 201, front contact *b* of $D_{101}$ relay and lead 202, would be 105 $H_z$. Succeeding sections to the left would each add 5 $H_z$ until the section that receives 150 $H_z$. Further sections to the left of this would receive 150 $H_z$ in accord with the principles described in earlier figures.

STATION STOPPING

Reference is now made to FIG. 3 and FIG. 3*a* which, when described earlier, made reference to the position of X contacts in each of the leads 61, 61*a*, 61*b*, 61*c* and 61*d* and were more specifically described in FIG. 3*a* where the X contact was shown and described as the front contact of a CR relay 113. This CR relay 113 and all of the respective X contacts are capable of remote control from a central control station not shown in FIG. 3 or FIG. 3*a*.

FIG. 3*b* shows in block diagram from a central control station 41 electrically connected via leads 42, 43, 44, 45 and 46 to X contact control units 47, 47*a*, 47*b*, 47*c* and 47*d*, respectively. As noted earlier, each X contact controls the operation of the related wayside speed control equipment designated generally by reference numeral 48. Keeping in mind the system illustrated in FIG. 1, FIG. 3, FIG. 3*a* and FIG. 3*b*, the central control station 41 sends out a control signal so that the X contact is open for the section just beyond the one in which the stop is desired. The X contacts for sections to the left are closed and if the detecting relays are in their picked-up position, the speed limits approaching the stop location would be as shown in FIG. 1 bringing the vehicle to a stop at braking distance (from 10 mph) past the entrance to the zero (0) frequency section. Accurate spot stopping is not considered as a requirement in this presentation, but this system would be with special provisions that might be made for spot stopping when required. To skip a station, all that is required is to have all of the X contacts in the closed position.

When leaving a station, it is considered desirable to advance the frequency in accord with acceptable acceleration taking into account the maximum value consistent with comfort to the passengers. This control is assumed to be accomplished either on the vehicle or from the central control station 41. If this feature is performed in response to controls from the central control station 41, it would be done by programming the opening and closing of contacts X ahead of the train so there would be the proper rate of increase in frequency for the desired acceleration of the vehicle.

In a somewhat similar manner the speed of a vehicle may be controlled from the central control station 41 by programming the opening and closing of the X contacts ahead of the vehicle. This would be for use in sections with temporary restrictions. Sections with permanent speed restrictions would be equipped with band pass filters with a cutoff at the selected speed restriction plus a simple control of the X contacts beyond the restricted zone.

While the actual apparatus of the central control station 41 has not been shown, it is believed that the description of the requirements for the programming of the controls from the central station to the CR relays of the sections (see FIG. 3*a* for the various vehicle movements) is sufficiently clear to permit those skilled in railroad traffic control to provide the equipment necessary for such operation.

Reference is now made to FIG. 6, FIG. 7 and FIG. 8 which, when taken together and functionally described, will set forth a system operation that allows for constant speed as well as acceleration. FIG. 6 represents a modification of the circuit shown in FIG. 5. A number of features have been added to this figure and these will now be described. A rail section 178 has connected thereto a lead 177 which has thereon a vehicle speed command signal which is delivered to the rail section 178 and to the vehicle speed signal generating unit 183 via lead 177*a*. A controlled coupling unit 184 is operatively associated with the other circuit elements in the same fashion as was described with reference to the earlier figures.

The vehicle speed signal generating unit 183 however is modified to include an S relay 185 and an Acc relay 186, respectively, electrically connected via leads 187, 188 to the central control station 41. The S relay may be referred to as a constant speed control means, while the Acc relay may be referred to as an acceleration control means for reasons that will become apparent hereinafter. Note also that the X contact 181 interposed in lead 179 between the rail section 178 and the vehicle detector unit 182 is also electrically connected via lead 189 to central control station 41. It can be seen, as is shown in FIG. 7, that each wayside speed control of this embodiment of the invention has an S relay, an Acc relay, as well as a relay controlled X contact.

The S relays added to each section along the wayside are under remote control from the central control station 41.

Referring back to FIG. 6 it can be seen that when the S relay 185 is energized over lead 187 from the central control station 41 a circuit will be completed from the d.c. source 190, lead 191, front contact *a* of S relay 185, lead 192, 193, 194 to alternator 195. With the alternator energized with d.c., as was explained earlier, the frequency transmitted to section 9 is the same as that received from section 7.

Thus constant speed of the vehicle for any desired distance may be obtained by energizing all S relays for the stretch of guideway over which constant speed might be desired.

In FIG. 6 the incremental speed signal source 196 contains five separate and differing individual signal sources. They are as follows: $f_1$ source 197, having a minus 10 $H_z$ signal output; $f_2$ source 198, having a minus 5 $H_z$ signal output; $f_3$ source 199, having a plus 5 $H_z$ signal output; $f_4$ source 200, having a 10 $H_z$ signal output and d.c. source 190 already noted. The application of these differing incremental speed signals will be explained more fully hereinafter.

The Acc relay 186 has been added to the vehicle speed signal generating unit 183 to facilitate acceleration. It will be observed that when the Acc relay 186 is energized and in its picked-up position and the S relay 185 is deenergized and released, the frequency transmitted over the front contact *a* of Acc relay 186 will be from $f_1$ source 197 over lead 201 and this frequency is of a negative value, i.e., minus 10 $H_z$. If Acc relay 186 is deenergized and released, with S relay 185 also released, the frequency transmitted over the back contact *a* of Acc relay 186 will be from $f_4$ source 200 over lead 202, and will be of a positive frequency, i.e., plus 10 $H_z$.

As was explained previously, the field of each alternator is of the two or three phase type, producing a rotating magnetic field the speed of which is dependent on the frequency received. When the alternator field is energized by d.c., the magnetic field is stationary. When the field is energized by a frequency of a negative value, this would result in the rotating magnetic field being in the same direction as the mechanical rotation and therefore the frequency output of the alternator is equal to that applied to the motor minus the frequency applied to the alternator field.

If both S relay 185 and Acc relay 186 are deenergized, then the circuit of FIG. 6 operates in the same fashion as that shown and described in FIG. 5.

With the operation of FIG. 6 in mind let our attention be directed to the diagram of FIG. 8. In FIG. 8 there is illustrated in a manner similar to FIG. 1 a dynamic speed relationship that exists between a vehicle A and a vehicle B. To the left of vehicle A in graphic form is a representation of the allowable speeds in each section to the rear of vehicle A. In addition to the right of vehicle B is also illustrated in graphic form the maximum allowable speeds that may be attained by vehicle B as it accelerates from the position shown in FIG. 8 in its movement to the right across this figure. In the middle of FIG. 8 there is depicted at a point 203 the maximum allowable speed of 150 mph. To continue our study of system operation let us assume that a vehicle such as vehicle B has stopped at a station and it is desired to accelerate the train promptly to the full speed of 150 mph. To accomplish this the Acc relays in the wayside equipment of each of the nine rail sections in advance would be energized and therefore picked up. This would effectively call for a 10 mph step-up in speed and for each of the next ten sections there would be called for a 5 mph step-up in speed per section. The X contact for each of these nineteen sections would be energized to allow completion of a circuit from each vehicle detector unit to the respective rail section. In like fashion the next twenty-one sections would also have the X contact in a circuit completion position. Note though that the S relays and Acc relays of the last 21 sections would be deenergized.

In this example, as can be seen illustrated in FIG. 8, the vehicle A ahead would be separated from vehicle B about to start from a station by 40 sections.

When specific attention is directed to vehicle A of FIG. 8 it is seen, as has been described earlier, there will be present in the first section to the left of the one occupied by the vehicle A a zero frequency signal. Each succeeding section to the left would have 10 $H_z$ increased speed signals with 100 $H_z$ appearing in the eleventh section to the left of vehicle A. Succeeding sections to the left would increase by 5 $H_z$ per section until the 21st section which would be at 150 mph, i.e., point 203 on the allowable speed curve. Of course, as noted earlier in this description, the 10 sections from the 150 mph point 203 to the left would allow for a decreased speed controlled by 5 $H_z$ increments and the final 9 sections would each decrease by 10 $H_z$, thereby giving an initial frequency of 10 $H_z$ to vehicle B starting from the station.

In order to further summarize the dynamic relationship that the system of this invention employs, attention is again directed to FIG. 8 where it has been noted that vehicle B is at a station and 10 $H_z$ frequency signal has been applied to this section. At this time instant vehicle A causes, by its very presence, successive steps up in frequency to the sections to its rear or left in FIG. 8, beginning with zero frequency for the first section to the rear and then in 10 $H_z$ steps to 100 $H_z$ in the 11th section. This sequencing, it will be recalled, is automatic and is in response to the X contacts being in a circuit completing position due to the CR relays (see FIG. 3*a*, 113) being picked up from the central control station 41 and the Acc and S relays being in their released position. In FIG. 8 this portion of the diagram is shown as a region 1. In this example the incremental allowable speeds above 100 mph are to be in 5 $H_z$ or 5 mph increments. These steps are also made automatically in response to all X contacts of CR relays for each section being picked up and all Acc and S relays in these respective sections being in their released positions. If the operation of FIG. 5 is referred to, it will be recalled, the incremental signal changes are reduced to 5 $H_z$ above 100 $H_z$ because these frequencies do not pass through 10–90 band pass filter 174 and therefore F relay 179 is in its released position, thereby allowing the selection of 5 $H_z$ from incremental speed signal source 189 instead of 10 $H_z$ from incremental speed signal source 183. Region 2 of FIG. 8 embodies the above referred to 5 $H_z$ or 5 mph allowable incremental speeds.

It will be recalled, as was explained with reference to FIG. 5, the maximum frequency is limited to 150 $H_z$ by use of the 10–140 band pass filters 148, 148*a* and their respective E relays 150, 150*a*.

In order to establish the progressive frequency patterns depicted in this FIG. 8 for the vehicle B all the X contacts of the CR relays for those rail sections designated with regions 3 and 4 are in a circuit completing position. The S relays at all sections are released. The frequency at the 20th section ahead of vehicle B is 150 $H_z$. This frequency is reduced in steps of 5 $H_z$, as previously noted, unitl 100 $H_z$ is reached and then the steps are 10 $H_z$, each down to the 10 $H_z$ which is fed to the section occupied by vehicle B.

From the foregoing description it can be seen that with X contacts closed to complete circuits for all sections illustrated and the S relay for all sections released, as well as the Acc relays released for rail sections in regions 1 and 2 but picked up for rail sections in regions 3 and 4 and vehicle A remaining stationary, vehicle B would accelerate to the maximum of 150 mph and then decelerate, coming to a stop in the section at the rear of vehicle A.

Note, however, if vehicle A moved forward, i.e., to the right, it would have the effect of moving rail section regions 1 and 2 to the right at a rate corresponding to the speed of vehicle A. This in turn would permit vehicle B to maintain the maximum speed for a greater period of time depending only on the movement of vehicle A. Accordingly, the top speed of vehicle B, shown in FIG. 8 at the mid point of the diagram, would be allowed to continue from rail section to rail section at a rate directly proportional to the speed of vehicle A.

A major contribution offered by this invention resides in the inherent safety of the system. It can be seen that regardless of the positions of CR, S and Acc relays it is not possible to set up frequencies in the rear of vehicle A that would be higher than those shown. This means that from the standpoint of safety the control between the control station 41 and these relays may be of the non-vital type. The method of detection and the various D relays of the vehicle detecting units should be of the vital type.

If it should be desired to limit the speed of vehicle B to some value such as 100 mph, this could be accomplished by not picking up the CR relay (CR relay controls the X contact) of the section in which the vehicle A is located but picking up the CR relays for all intervening sections. The S and Acc relays would be released for all rail sections in region 1. The S relay would be picked up and the Acc relay released for the rail sections in regions 2 and 3. The Acc relay would be picked up and the S relay released for the rail sections in region 4. Under these conditions regardless of the movement of vehicle A to the right, vehicle B would accelerate through region 4 to 100 mph and maintain that speed through regions 3 and 2. Then if traffic conditions ahead were safe, the 100 mph steady speed could be maintained by energizing more CR relays in advance and also energizing more S relays.

Any vehicle may be decelerated at any time by creating the equivalent of an occupied section in advance. For smooth deceleration the equivalent of the occupied section should be selected far enough in advance that the vehicle would reduce in speed in accord with the path indicated by regions 1 and 2 on FIG. 8.

If it was desired to reduce the speed of the vehicle and then continue at some reduced speed, this would be accomplished by operating the S relay for a number of sections in advance and then energizing the CR relays for the same number of sections plus the number of sections to permit the corresponding frequency to be generated. Accordingly, for 100 mph it would be necessary to energize the CR relays for 11 sections beyond the section where the last S relay was energized.

If it is desired to accelerate the vehicle from a constant speed to some higher speed, this may be done by energizing the proper number of Acc relays in advance. This would set up a speed sequence as represented by rail section regions 3 and 4 in FIG. 8. By proper selection of the Acc relays in advance, it is possible to enter this sequence at any speed and leave at the desired higher speed.

Thus it is obvious that the system as described and including the features of FIG. 6 has the flexibility to permit the operation of vehicles as desired from the central control station 41. It is possible to accelerate, decelerate, stop at a selected section, or operate the vehicle at a constant speed, all under control of the central station 41 and all operations are completely protected from a safety standpoint by equipment on the wayside.

While the actual apparatus at the central control station 41 has been been shown, it is believed that the description of the requirements for the programming of the controls from the central station to the relays of the sections for the various vehicle movements is sufficiently clear to permit those skilled in railroad traffic control to design the control station.

While the present invention has been illustrated and disclosed in connection with the details of illustrative embodiments thereof, it should be understood that those illustrative embodiments are only to be limitative of the invention as set forth in the accompanying claims. By way of example but not limitation there has been shown for purposes of explanation a vehicle signal generating unit which allows for the incremental addition of frequencies. The invention of course contemplates that this frequency adding capability might also be accomplished by solid state techniques that are the full equivalent of the apparatus shown and described.

Having thus described my invention, what I claim is:

1. A signal system for vehicles traveling along a predetermined way, said system having at least two consecutive sections and a vehicle to be controlled by a vehicle speed control signal received during travel through each section, each section including, a. vehicle detector means to detect a vehicle in said section electrically connected to a next preceding vehicle detector means, b. a coupling means controlled by said vehicle detector means, c. a vehicle speed signal generating means controllably coupled by said vehicle detector means through said coupling means respectively to a next preceding section and to a vehicle speed signal generating means of a next preceding section to deliver a vehicle speed control signal to said preceding section, when the section is unoccupied and the next succeeding section is occupied, d. an incremental speed signal source providing respectively a signal to said vehicle speed signal generating means and to said coupling means, said incremental speed signal being delivered through said coupling means only when said section is unoccupied and the next succeeding section is occupied.

2. The signal system of claim 1 wherein said detector means includes a relay, which relay controls a plurality of contacts located respectively in said vehicle speed signal generating means and said coupling means to thereby provide control of said vehicle speed control signal and said incremental speed signal.

3. The signal system of claim 2 wherein said vehicle speed signal generating means includes a motor coupled to an alternator, said motor speed controlled by said vehicle speed signal from the next succeeding section to thereby drive said alternator at a speed directly proportional to said vehicle speed signal.

4. The signal system of claim 3 wherein said alternator has connected thereto said incremental speed signal to thereby add to the alternator output said incremental signal.

5. The signal system of claim 4 wherein said vehicle speed signal has a frequency directly proportional to a desired safe vehicle speed and said incremental speed signal has a frequency less than said vehicle speed signal.

6. The signal system of claim 1 wherein said vehicle speed signal generating means includes a vehicle speed signal filter means to control said incremental signal to said speed signal generating means to thereby limit the maximum speed signal that may be delivered to said next preceding speed signal generating means.

7. The signal system of claim 6 wherein said incremental speed signal source has at least three incremental speed signal outputs and at least one of said three incremental speed signal outputs provides a zero incremental speed signal, which zero incremental speed signal is controllably coupled to said vehicle speed signal generating means by said vehicle speed signal filter means.

8. The signal system of claim 7 wherein said detector means includes a relay, which relay controls a plurality of contacts located respectively in said vehicle speed signal generating means and said coupling means to thereby provide control of said vehicle speed control signal and said incremental speed signal outputs.

9. The signal system of claim 8 wherein said vehicle speed signal generating means includes a motor coupled to an alternator, said motor speed controlled by said vehicle speed signal from the next succeeding section to thereby drive said alternator at a speed directly proportional to said vehicle speed signal.

10. The signal system of claim 9 wherein said alternator has connected thereto one of said incremental speed signals to thereby add to the alternator output said incremental signal.

11. The signal system of claim 1 wherein there is included in combination a central control station electrically connected to means controllably associated with each vehicle detector means to thereby render ineffective any of said vehicle detector means and thereby provide an overall system control in addition to that provided by the presence of said vehicles.

12. The signal system of claim 1 wherein said speed signal generating means includes at least two speed signal filter means one of which controls said incremental signal to said speed signal generating means to thereby limit the maximum speed signal to be delivered to said next preceding speed signal generating means, while the other speed signal filter acts in cooperation therewith to provide one of two different incremental speed signals over two different speed signal ranges.

13. The signal system of claim 12 wherein said speed signal generating means includes a constant speed control means electrically coupled to a central control station, said constant speed control means electrically interposed between said incremental speed signal source and said speed signal filter means.

14. The signal system of claim 12 wherein said speed signal generating means includes an acceleration control means electrically coupled to a central control station, said acceleration control means electrically interposed between said incremental speed signal source and said speed signal filter means.

15. The signal system of claim 12 wherein said speed signal generating means includes constant speed control means and an acceleration control means, each separately electrically coupled to a central control station, said constant speed control means and said acceleration control means having an electrical coupling interposed between said incremental speed signal source and said speed signal filter means.

16. The signal system of claim 15 wherein said incremental speed signal source has at least three different incremental speed signal outputs and at least one of said three incremental speed signal outputs provides a zero incremental speed signal, which zero incremental speed signal is controllably coupled to said vehicle speed signal generating means through said electrical coupling of said constant speed and acceleration control means, at least two remaining incremental speed signals are of different natures, to thereby provide said speed signal generating means with differing incremental speed signals at least one of which allows for acceleration.

17. The signal system of claim 12 wherein said incremental speed signal source has at least three incremental speed signal outputs and at least one of said three incremental speed signal outputs provides a zero incremental speed signal, which zero incremental speed is controllably coupled to said vehicle speed signal generating means by one of said vehicle speed signal filter means, while two of the remaining incremental speed signals are different, to thereby provide said speed signals generating means with said differing incremental speed signals for said differing ranges.

18. The signal system of claim 17 wherein said detector means includes a relay, which relay controls a plurality of contacts located respectively in said vehicle speed signal generating means and said coupling means to thereby provide control of said vehicle speed control signal and said incremental speed signal outputs.

19. The signal system of claim 18 wherein said vehicle speed signal generating means includes a motor coupled to an alternator, said motor speed controlled by said vehicle speed signal from the next succeeding section to thereby drive said alternator at a speed directly proportional to said vehicle speed signal.

20. The signal system of claim 19 wherein said alternator has connected thereto one of said incremental speed signals to thereby add to the alternator output said incremental signal.

* * * * *